US010758447B2

(12) United States Patent
Biedermann

(10) Patent No.: US 10,758,447 B2
(45) Date of Patent: Sep. 1, 2020

(54) MASSAGE DEVICE

(71) Applicant: Alexander Biedermann, Vienna (AT)

(72) Inventor: Alexander Biedermann, Vienna (AT)

( * ) Notice: Subject to any disclaimer, the term of this patent is extended or adjusted under 35 U.S.C. 154(b) by 181 days.

(21) Appl. No.: 15/769,431

(22) PCT Filed: Oct. 21, 2016

(86) PCT No.: PCT/EP2016/075327
§ 371 (c)(1),
(2) Date: May 29, 2018

(87) PCT Pub. No.: WO2017/068105
PCT Pub. Date: Apr. 27, 2017

(65) Prior Publication Data

US 2018/0303703 A1 Oct. 25, 2018

(30) Foreign Application Priority Data

Oct. 23, 2015 (AT) ..... A 8009/2016

(51) Int. Cl.

| | |
|---|---|
| ***A61H 19/00*** | (2006.01) |
| ***A43B 13/14*** | (2006.01) |
| ***A61H 23/02*** | (2006.01) |
| ***A43B 3/00*** | (2006.01) |
| *A61H 21/00* | (2006.01) |

(52) U.S. Cl.
CPC ..... *A61H 19/32* (2013.01); *A43B 3/00* (2013.01); *A43B 3/0005* (2013.01); *A43B 3/0036* (2013.01); *A43B 13/14* (2013.01); *A61H 23/02* (2013.01); *A61H 21/00* (2013.01); *A61H 2201/0192* (2013.01); *A61H 2201/165* (2013.01); *A61H 2201/1642* (2013.01)

(58) Field of Classification Search
CPC ..... A61H 19/00; A61H 19/30; A61H 19/32; A61F 5/41; A43B 3/00; A43B 3/0005; A43B 13/14
USPC ..... 600/38–41
See application file for complete search history.

(56) References Cited

U.S. PATENT DOCUMENTS

| | | | |
|---|---|---|---|
| 5,988,467 | A | 11/1999 | Brustein |
| 6,289,612 | B1 | 9/2001 | Kent |
| 2011/0082333 | A1 | 4/2011 | Wilson et al. |
| 2012/0178990 | A1 | 7/2012 | Astin |
| 2013/0245366 | A1 | 9/2013 | Rhodes et al. |

FOREIGN PATENT DOCUMENTS

DE 20113432 U1 12/2001

OTHER PUBLICATIONS

Anonymous, Penis Shoe:virtualshoemuseum.com, http://web.archive.org/web/20140702035556/http://www.virtualshoemuseum.com/zjef-van-bezouw/penis-shoe , Jul. 2, 2014, XP055333743, p. 1, figure 1.
Anonymous, Penis Shoe:virtualshoemuseum.com, http://web.archive.org/web/20140702035556/http://www.virtualshoemuseum.com/zjef-van-bezouw/penis-shoe, Jul. 2, 2014, XP055333739, p. 1, figure 1.

*Primary Examiner* — John P Lacyk
(74) *Attorney, Agent, or Firm* — David Guerra

(57) ABSTRACT

Shoe-shaped, foot-operated massage device, in particular a shoe-shaped, foot-operated masturbator for men, comprising a footbed (1), an upper (2), a shoe opening (3) between the upper (2) and the footbed (1) for accommodating a foot or to be temporarily connected to a foot, a sole (4), and a base (5) between the footbed (1) and the sole (4), an open masturbator position being provided in order for a penis to be accommodated therein.

20 Claims, 4 Drawing Sheets

MASSAGE DEVICE

CROSS-REFERENCE TO RELATED APPLICATIONS

This application is an U.S. national phase application under 35 U.S.C. § 371 based upon co-pending International Application No. PCT/EP2016/075327 filed on Oct. 21, 2016. Additionally, this U.S. national phase application claims the benefit of priority of co-pending International Application No. PCT/EP2016/075327 filed on Oct. 21, 2016 and Austria Application No. A8009/2016 filed on Oct. 23, 2015. The entire disclosures of the prior applications are incorporated herein by reference. The international application was published on Apr. 27, 2017 under Publication No. WO 2017/068105 A1.

BACKGROUND

Technical Field

The invention relates to a massage device, in particular, a shoe-shaped, foot-operated massage device, preferably a shoe-shaped, foot-operated masturbator for men.

BACKGROUND DESCRIPTION

Massage devices and masturbators of various designs are known and have been published. However, there exists a market demand for massage devices or masturbators in shoe form. In particular, there exists also a demand for foot-operated massage devices and masturbators. It is the object of the invention to now satisfy the existing, above-mentioned market demand.

BRIEF SUMMARY OF THE PRESENT TECHNOLOGY

In that context, the invention relates to a shoe-shaped, foot-operated massage device, in particular a shoe-shaped, foot-operated masturbator for men, including a foot bed, a shoe upper, a shoe opening between the shoe upper and the foot bed for accommodating a foot or to be temporarily connected to a foot, a sole and a base body between the foot bed and the sole. The shoe upper, the base body and/or the heel may be freely selected for each shoe model and may, in particular, be so designed as to form, for example, a boot, a high-heeled shoe, a pumps, a sports shoe, a flip-flop shoe or a men's shoe. Optionally, the invention further refers to two massage devices which together form a pair of shoes, wherein the two massage devices can be mirrored or formed differently.

Optionally, it is provided that a masturbator recess for accommodating a penis is provided.

Optionally, it is provided that the masturbator recess is designed as a groove provided in the foot bed, as a groove provided in the sole, as a channel passing through the shoe-shaped form, as a channel passing through the base body, as a channel, open on one side, penetrating the base body and/or as a groove or channel extending along the longitudinal direction of the shoe shape. Optionally, it is provided that the masturbator recess is bounded by a deformable, elastically deformable, soft and/or shape-adaptable masturbator wall.

Optionally, it is provided that a pin-shaped heel is provided which projects from the heel region, so that the massage device is stiletto-shaped. Optionally, it is provided that the free end of the pin-shaped heel is rounded or pointed.

Optionally, it is provided that the pin-shaped heel has a deformable, elastically deformable, soft and/or shape-adaptable surface or configuration.

Optionally, it is provided that the longitudinal direction of the heel and the longitudinal direction of the masturbator recess are situated substantially in a plane and, in particular in a plane following the longitudinal direction of the shoe shape.

Optionally, a gap or recess for accommodating the male scrotum may be provided between the masturbator recess and the heel. Optionally, it is provided that the longitudinal direction of the heel and longitudinal direction of the masturbator recess are substantially in one plane and at an angle to one another of about 60° to 120°, and, in particular of about 90°, or, optionally, are pivotal relative to one another with limited flexibility. In order for the heel to be pivotal in relation to the base body or in relation to the masturbator recess, a hinge or articulation, for example, may be provided. The shape of the heel may be adapted in accordance with the purpose of use or the shoe shape.

Optionally, it is provided that the base body includes a fixed support frame, which extends up to or into the heel and is connected to the sole via the heel.

Optionally, it is provided that the support frame is constructed of a plurality of parts and includes two parts, movable, slidable or guided slidably in relation to one another, a first part being connected to the heel and a second part to the component supporting the masturbator recess so that the distance between the heel and the masturbator recess is adjustable by moving the two parts in relation to each other.

Preferably, the massage device is so designed and adapted to the anatomy of a human body that the heel may be inserted rectally, while the penis is present in the masturbator recess.

Optionally, it is provided that the direction of movement is substantially in that plane in which the longitudinal direction of the heel and the longitudinal direction of the masturbator recess are situated as well. Optionally, it is provided that the masturbator recess, the heel, the foot bed, the sole and/or the entire massage device is/are coated with a washable, waterproof hygiene layer.

Optionally, it is provided that a vibration device is included.

Optionally, provision is made for an aperture to be provided for the connection to a vibration device.

In addition, the following features may be provided:

The masturbator recess, or, respectively, the penis guide formation is, for example, a groove having a diameter of at least 3 to 5.5 cm. The average measurement is, for example, a 4.2 cm outer diameter of the penis. Using a 5.5 cm diameter and a foam insert, the range from 3 to 5 cm can be covered, thereby simultaneously attaining shape matching. Optionally, the groove or recess terminates in a hole or an opening.

The foam is optionally coated with an elastic, form-fitting and stretchable material. The latter should be well tolerated by the skin and should be washable.

A hygiene layer or the coating may be made of silicone, synthetic materials, nylon, leather or other elastic materials that conform to the foam padding and the body shapes. For hygienic reasons, the former should be washable.

Since both the shoe and the penis guide formations should be adapted to the anatomical requirements of the users, different basic sizes of the shoe are conceivable. The proportions correspond, for example, to ⅕ partitions of the human foot and average size of male penises. In this context, it should be mentioned that two sigma, 95,4%, of male penises manage with a maximum diameter size of 5,5 cm of the guide formation, for which reason this (including padding) can be the constructive maximum dimension for standard production.

The foot bed is preferably padded. This enables an adaptation to the foot. For this purpose, synthetic materials and memory-foam, for example, may be considered.

To meet the shoe association demand, it is advantageous to design the massage device in shoe form. In order to accentuate the foot, the foot pad, heel and arch are optionally open and anatomically shaped. The sole of the shoe may in this case have a minimum thickness of 2 cm to permit the formation of a guide groove. As shoe sizes vary widely, it is advantageous to offer a plurality of sizes. The European ladies' standard size 39 can serve as the base size for this purpose.

The base body and/or the support frame may include form-stable, lightweight, resilient materials, such as wood (preferably beech wood), synthetic materials, rubber, silicone, light metal, acrylic glass.

The paddings may contain elastic, form-stable materials, such as foam, silicone, rubber, soft polymers, feathers, chips etc.

The hygiene layer or the coating may contain stretchable materials suitable as a coating, such as silicone, nylon, leather, synthetic materials, textiles, rubber, polymers, woven materials, carpeting materials.

The penetration of very sensitive areas by the heel preferably requires stability and soft, round, edgeless outer shapes. As a model, the human finger is used in this context, which, owing to its dome-shape and ability to bend easily facilitates stimulation. Stretching and elastic movements in the genital areas [are] perceived by many people as stimulating, for which reason the heel may be designed thicker towards the top.

The heel is preferably positioned on a portion of the support frame, in particular on a rail on the base shoe and may optionally be selectively fixed or released in all embodiments. The shoe may then be moved in the longitudinal direction, even if the heel is fixed due to being accommodated within the body. The slide can optionally be locked in the base position. The slide may in this base position be secured such that a stable support is provided. Flexibility means or paddings ensure impact reduction.

Optionally, a swivel joint is provided in all embodiments between the heel and the support frame, which swivel joint permits a radial displacement or pivoting of the shoe in relation to the end point of the heel, thus improving the freedom of movement.

BRIEF DESCRIPTION OF THE DRAWINGS

In what follows, the invention will be further described by way of different examples of embodiments, wherein.

DETAILED DESCRIPTION OF THE PREFERRED EMBODIMENTS

Figure 1:
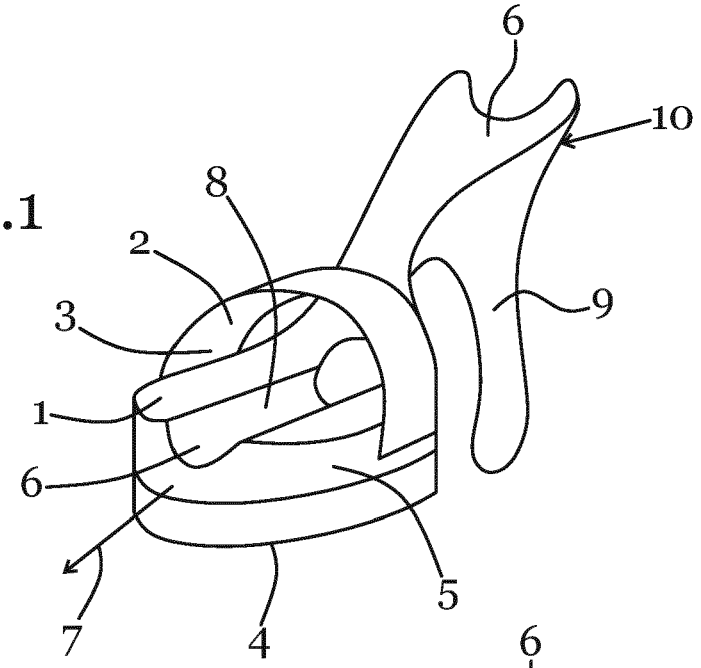
FIG. 1 shows a schematic oblique view of a possible embodiment of a massage device.

Unless otherwise specified, the reference numerals correspond to the following components: foot bed 1, shoe upper 2, shoe opening 3, sole 4, base body 5, masturbator recess 6, longitudinal direction 7, masturbator wall 8, heel 9, heel region 10, support frame 11, first part (of the support frame) 12, second part (of the support frame) 13, hygiene layer 14.

FIG. 1 shows a schematic oblique view of a possible embodiment of a massage device according to the invention, including a foot bed 1, a shoe upper 2 and a shoe opening 3, formed between the shoe upper 2 and the foot bed 1, adapted and suited, in particular, for receiving or fixing a human foot. Further, a sole 4 is provided. Between the sole 4 and the foot bed 1 a base body 5 is provided, which may optionally be formed of a plurality of parts in all embodiments. In addition, the massage device includes a masturbator recess 6, which is adapted to receive a penis at least partially or completely. In the present embodiment, the masturbator recess 6 extends substantially along the longitudinal direction 7 of the shoe form of the massage device and is open in upward direction, that is to say, in the direction of the shoe opening 3, or, respectively, in the direction of the foot accommodated in the shoe opening 3. In particular, the masturbator recess 6 is so designed that the penis is only received partially by the masturbator recess 6, so that, in use, this results in an abutment against the foot situated in the shoe opening 3. The masturbator recess 6 is bounded, in particular, by a masturbator wall 8. In this embodiment, the masturbator wall is substantially hemicylindrical or channel-shaped, respectively.

Further, the present embodiment includes a heel 9, which is preferably pin-shaped. The heel 9 projects from the shoe-shaped massage device, particularly from the heel region 10. In addition, a further second masturbator recess 6 is provided in the heel region 10.

In the present embodiment, the heel 9 is, in particular, rounded or pointed and preferably suited and/or adapted in all embodiments for rectal insertion.

The masturbator wall 8 and/or the surface of the heel 9 are preferably designed to be shape-adaptable and/or elastically deformable. This means, in particular, that the masturbator wall is formed resiliently or soft, so that the massaging comfort is improved and/or that an adaptation to the size of the penis can take place. The wall may in this context be the surface of a soft body or a flexible film.

Figure 2A:
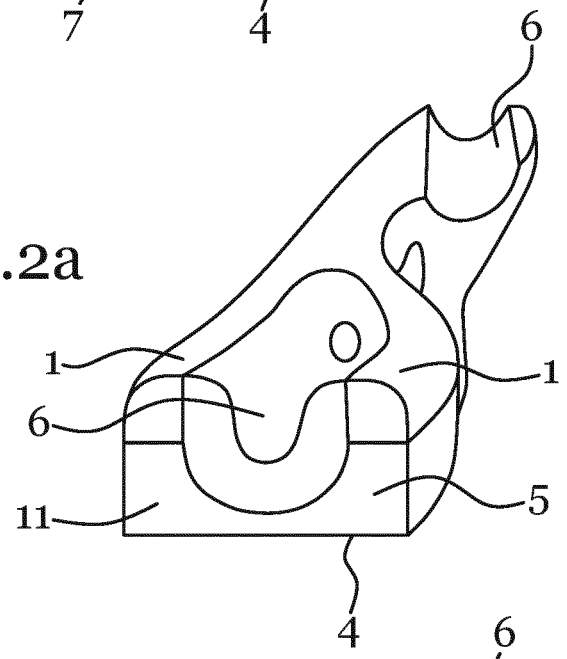
FIGS. 2*a* and 2*b* show partial sections of components of a further embodiment of a massage device according to the invention.
Figure 2B:
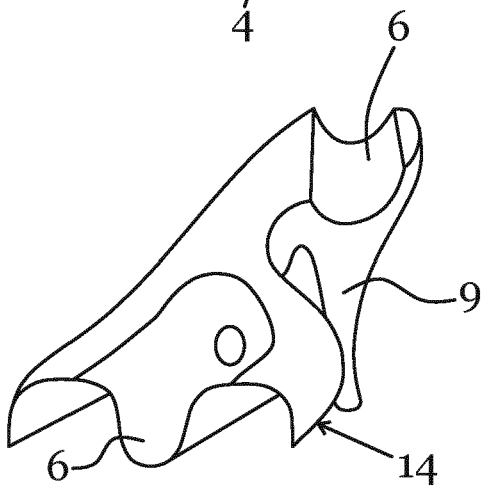

FIG. 2 shows a partial sectional view of a further embodiment of a massage device according to the invention with two masturbator recesses 6, a heel 9, a sole 4 and a base body 5. The base body 5, as can be seen in FIG. 2*a,* is formed in a plurality of parts. Particularly in the region of the front masturbator recess 6, it includes a soft pad which extends around the masturbator recess 6 into the base body 5. The foot bed is optionally likewise lined with a soft pad. The sole 4 is optionally fitted to a solid or rigid part of the base body 5, which may, in particular, also be a rigid support frame 11. FIG. 2*b* shows a further component of the embodiment of FIG. 2*a,* in particular, a hygiene layer 14 extending over portions of the massage device, or, respectively, over the entire massage device. In the present embodiment, the hygiene layer 14 is so designed that it coats or covers the foot bed 1, the masturbator recess 6 and the heel. However, if desired, but not shown, the entire massage device may be coated with a hygiene layer 14 as well. This hygiene layer 14 is, in particular, formed as a washable and/or waterproof layer.

Figure 3:
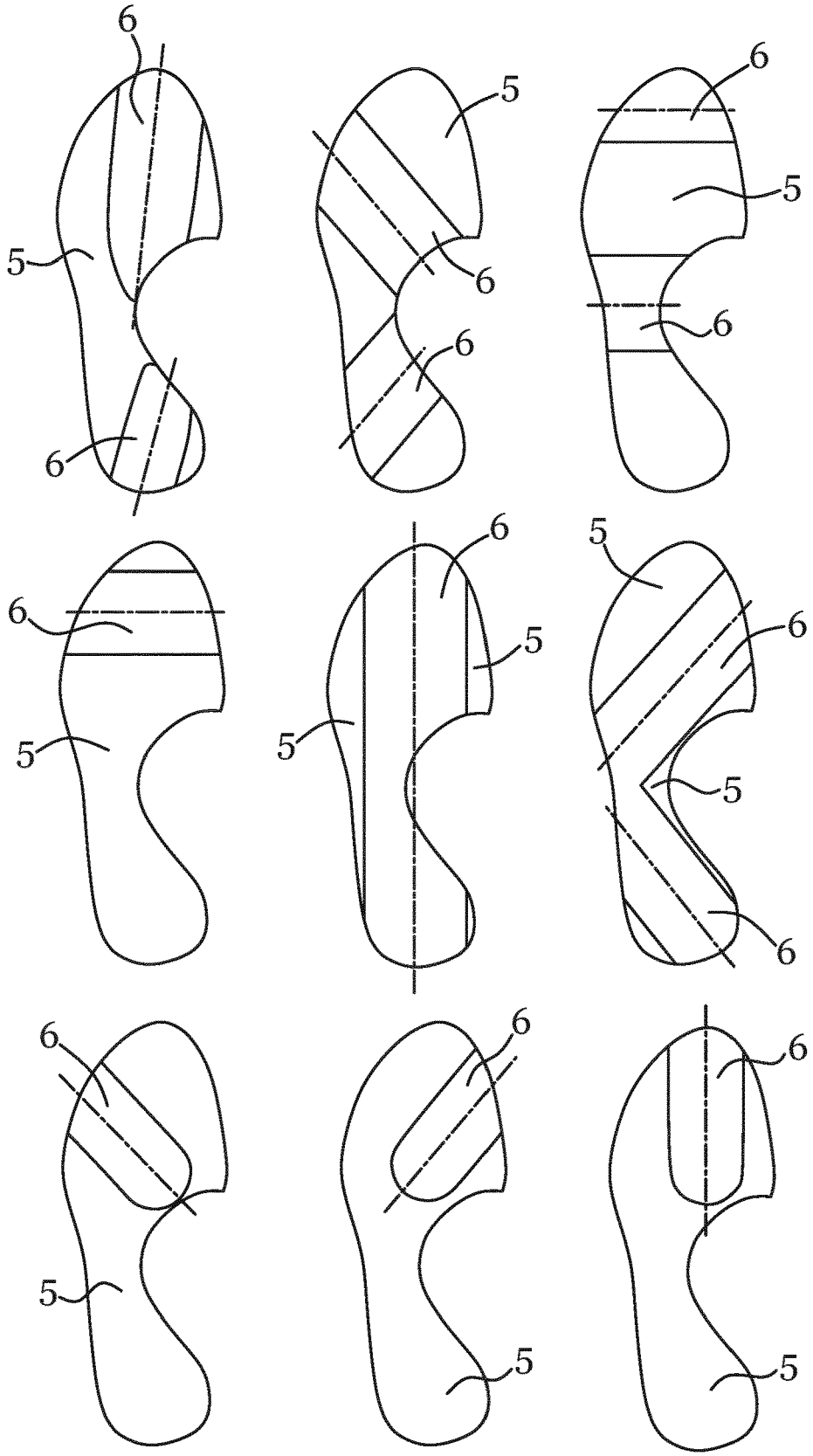
FIG. 3 shows various embodiments of the masturbator recesses.

FIG. 3 shows various embodiments or orientations of masturbator recesses 6 in the base body 5. The masturbator recesses 6 may be formed, for example, as open-ended passage openings, openings closed on one side and/or may be channel-shaped.

Figure 4A:
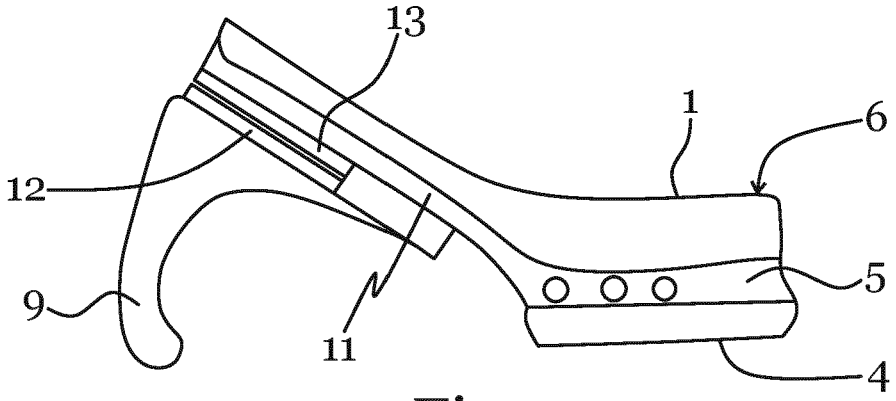
FIG. 4 shows the operating mode of the mobile support frame.
Figure 4B:
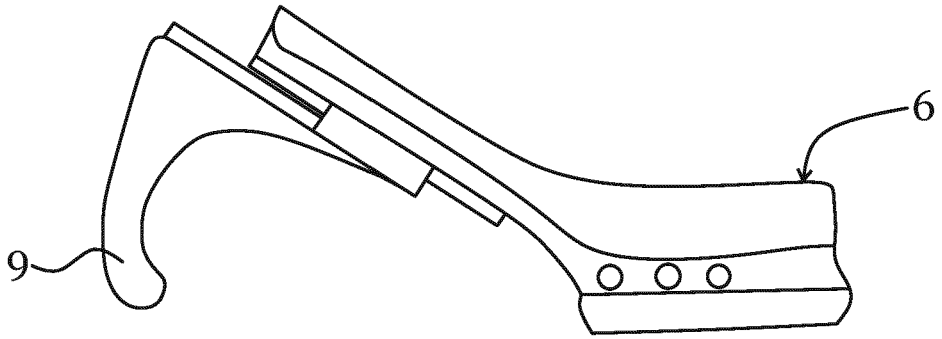
Figure 4C:
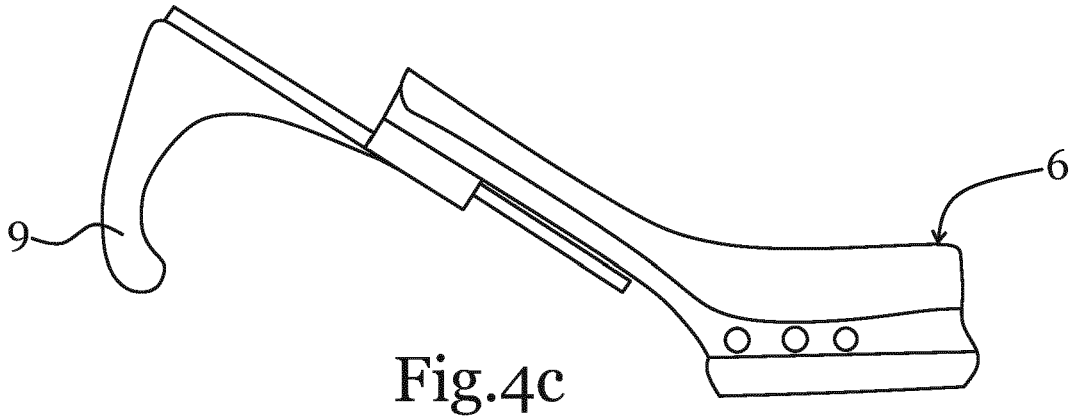

FIG. 4 shows a further embodiment of a massage device according to the invention, wherein the shoe upper 2 is not shown. In all embodiments, the shoe upper 2 may be formed according to a conventional shoe. The massage device again includes a foot bed 1, a sole 4, a masturbator recess 6, not visible in this view, a heel 9, as well as a base body 5. The base body 5 includes a support frame 11. This support frame 11 is designed in a plurality of parts in the present embodiment and includes a first part 12 and a second part 13. The first part 12 is connected to the heel 9 and is preferably rigidly connected to the heel 9. The second part 13 is connected to the masturbator recess 6 or to the part of the massage device supporting the masturbator recess 6, in particular, rigidly connected thereto. Preferably, the second part 13 is also rigidly connected to the sole 4. The two parts 12, 13 are, in particular, so arranged in relation to one another that a rigid but movable support frame 11 is formed. In particular, the support frame 11 is so rigid that the shoe functions, for example, as a shoe fit for walking. Thus, the heel 9 is connected to the sole 4 in a sufficiently rigid manner. The parts 12, 13 are preferably guided slidably relative to one another so that the distance between the heel 9 and the masturbator recess 6 may be varied. This serves, in particular, for adapting the massage device to the anatomy of the person on which the massage is performed. FIGS. 4*a*, 4*b* and 4*c* show three positions, in which the distance between the heel 9 and the masturbator recess 6 is varied. Preferably, stops are provided on both sides of the rail-like guide formation, so that the portion supporting the heel cannot separate from the rest of the massage device. Optionally, the two parts are, however, also designed to be separable from one another.

Figure 5A:
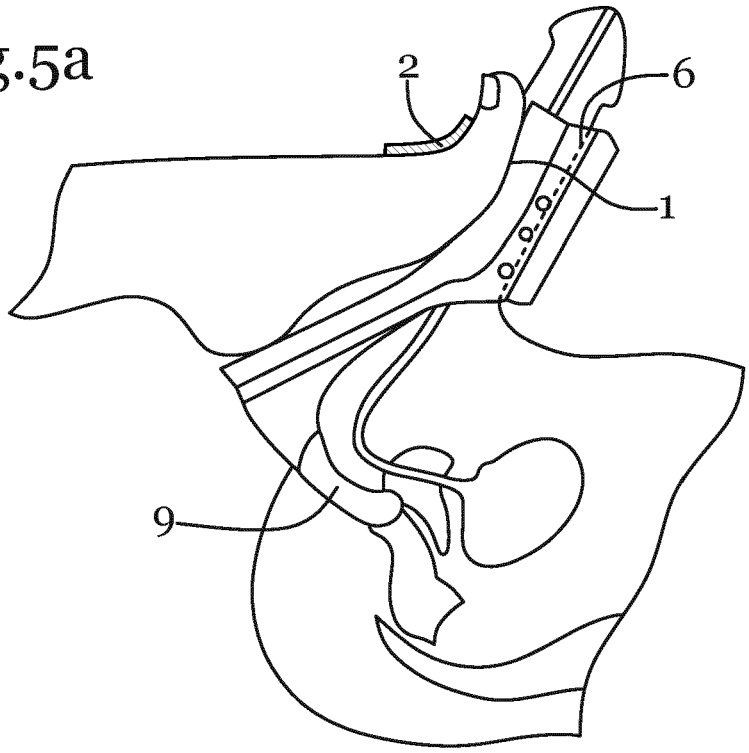
FIG. 5*a* and FIG. 5*b* show different positions of the massage device in operation.
Figure 5B:
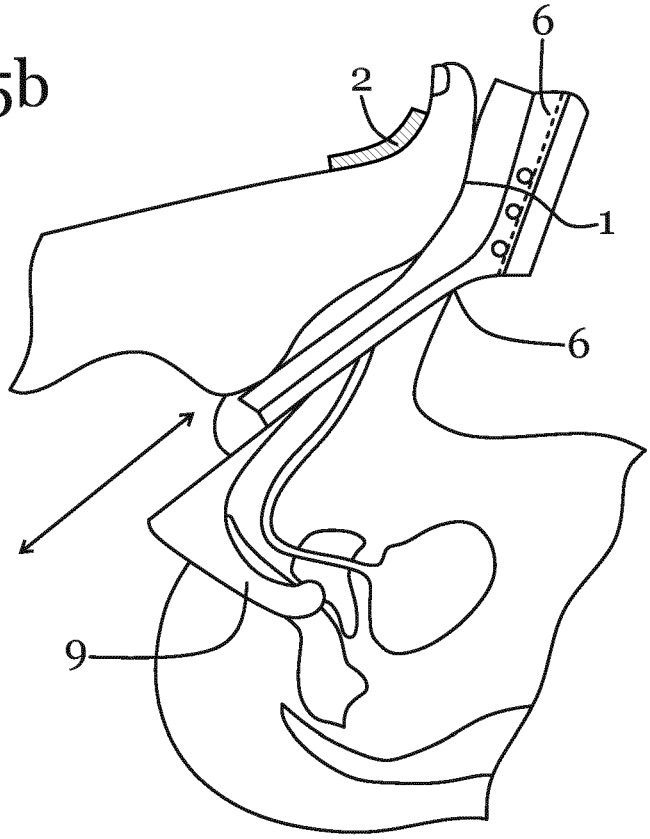

FIGS. 5*a* and 5*b* show schematic (partial) cross-sectional views of two different positions of use, as they can, for example, be made use of in succession by using the massage device. A foot is firmly held between the foot bed 1 and the shoe upper 2. This permits an actuation of the massage device by a foot. In both positions the heel 9 is inserted rectally, the penis of the same person being located at the same time in the masturbator recess 6. In particular, by varying the distance between the heel 9 and the masturbator recess 6, the effectiveness of massage can be improved.

Optionally, the massage device includes a vibration device, not illustrated. The latter may, for example, be arranged in or moulded into the region of the sole 4 or the region of the heel 9, preferably in the interior of the components. Optionally, an electric line extends to the outside of the massage device to enable a battery, required for generating the vibration, to be recharged. Optionally, there is also provided an aperture or a region for installing an external vibration device.

According to an embodiment of the invention, not shown, the heel may be formed as a removable or interchangeable heel, particularly as a removable or interchangeable high heel. This allows different heels to be fitted to the massage device. The different heels may, for example, differ from one another in form, material, thickness, curvature etc.

In all embodiments, it may be provided that the heel is made of steel, particularly stainless steel. Optionally, it may be provided that the heel, in the region of its tip, has a diameter of only 3 mm to 5 mm over an area of several centimetres.

According to an embodiment, not shown, provision may be made for the masturbator recess, bounded by the masturbator wall, to be arranged removably in a module connected or connectable to the base body and/or the support frame. The shape of such module may, for example, correspond to the middle region of the embodiment shown in FIG. 2*a*. The removable module may, for example, be formed similar to the U-shaped element in FIG. 2*a*. A connection to the other components of the massage device may be established via conventional connecting means, such as, for example, via a guided and/or interlocking insert or similar means. For example, a plurality of different modules may be provided, which may be connected selectively to the remaining components of the massage device. This embodiment permits, for example, to vary the size and/or also the physical properties of the masturbator recess and/or the masturbator wall. Furthermore, a removable module also simplifies cleaning of the components of the massage device provided on the module, in particular of the masturbator recess and the masturbator wall. The removable module may, for example, include the masturbator recess and the masturbator wall. Optionally, the module includes the foot bed and/or the shoe upper and/or a portion of the base body. Preferably, the module or each module completes the outer shape or the shoe configuration of the massage device.

Optionally, the removable module may be arranged, or adapted to be arranged, between the shoe upper and the base body or between the shoe upper and the foot bed. Specifically, in this embodiment, the removable module containing the masturbator recess, may be arranged in the shoe opening.

Optionally, all embodiments may provide that the massage device includes an insert which is disposed on the foot bed or which forms the foot bed. Such insert may, for example, include leather, one or more gel pads, or other materials. The connection of this insert may, for example, be brought about via conventional connecting means, such as ribbons, buttons or a Velcro fastener.

According to an embodiment, not shown, a vibration device may be provided in the heel or even in the region of the ball of the foot.

The invention claimed is:

1. A massaging device comprising:

a foot bed defining a recess;

a shoe upper;

a shoe opening defined between said shoe upper and said foot bed, said shoe opening having a configuration capable of receiving a foot; and a sole;

wherein said recess is in communication with said shoe opening, and said recess having a configuration capable of accommodating a penis.

2. The massaging device of claim 1 further comprises a base body arranged between said foot bed and said sole.

3. The massaging device of claim 1, wherein said recess is defined at least in part along a longitudinal axis of said foot bed.

4. The massaging device of claim 1, wherein said recess is at least partially lined with at least one of a deformable material, an elastically deformable material, and a shape-adaptable material.

5. The massaging device of claim 1, wherein said foot bed further comprises a heel area and a heel protruding from said heel area.

6. The massaging device of claim 5, wherein a free end of said heel is rounded or sharpened.

7. The massaging device of claim 5, wherein at least a part of said heel includes at least one of a deformable surface, an elastically deformable surface or a shape-adaptable surface.

8. The massaging device of claim 5, wherein an longitudinal axis of said heel and the longitudinal axis of said recess lie substantially in a same plane.

9. The massaging device of claim 8, wherein the longitudinal axis of said heel and the longitudinal axis of said recess lie substantially at an angle of about 60° to 120° to each other.

10. The massaging device of claim 5, wherein said heel is movable or pivotable relative to said recess.

11. The massaging device of claim 5, wherein said base body comprises a support frame extending to or into said recess, and wherein said sole is connected to said support frame.

12. The massaging device of claim 11, wherein said support frame comprises at least two mutually movable, displaceable or guided displaceable parts, wherein a first part includes said heel and a second part is connected to said foot bed, so that a distance between said heel and said recess is adjustable by moving said first part and said second part are relative to each other.

13. The massaging device of claim 12, wherein said first part and said second part are mutually rail-guided sliding parts, respectively, and that a direction of displaceability of said first part and said second part is substantially in a plane including a longitudinal axis of said heel and a longitudinal axis of said recess.

14. The massaging device of claim 5, wherein at least one of said recess, said heel, said foot bed, and said sole is coated with a waterproof layer.

15. The massaging device of claim 5, wherein said heel has an arcuate profile with a convex side directed away from said recess and a concave side directed toward said recess.

16. The massaging device of claim 1 further comprises at least one of a vibration device or an aperture defined in said foot bed configured to receive a vibration device.

17. The massaging device of claim 2, wherein said recess extends into said base body.

18. The massaging device of claim 1, wherein said foot bed includes a heel area offset from a section of said foot bed defining said recess, said heel area defining a second recess configured to receive a penis.

19. The massaging device of claim 18, wherein a longitudinal axis of said second recess has an orientation selected from the group consisting of angled in relation to a longitudinal axis of said recess, in-line with the longitudinal axis of said recess, parallel with the longitudinal axis of said recess, and parallel with the longitudinal axis of said recess with said longitudinal axis of said recess and said second recess being perpendicular with a longitudinal axis of said foot bed.

20. A method of using a massaging device, said method comprising the steps of:

inserting a penis into a recess defined in a foot bed of a massaging device that includes a sole, wherein said recess is in communication with a shoe opening defined between a shoe upper and said foot bed;

inserting a foot into said shoe opening so that the penis is between the foot and said foot bed; and moving said massaging device or the penis to impart a massaging action on the penis.

* * * * *